US008739758B2

(12) United States Patent
Friedmann

(10) Patent No.: US 8,739,758 B2
(45) Date of Patent: Jun. 3, 2014

(54) SYNCHRONIZING CLUTCH MECHANISM FOR A SPLIT CRANKSHAFT IN AN INTERNAL COMBUSTION ENGINE

(71) Applicant: Schaeffler Technologies AG & Co. KG, Herzogenaurach (DE)

(72) Inventor: Oswald Friedmann, Lichtenau (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/624,177

(22) Filed: Sep. 21, 2012

(65) Prior Publication Data

US 2013/0014727 A1 Jan. 17, 2013

Related U.S. Application Data

(63) Continuation of application No. PCT/DE2011/000194, filed on Feb. 28, 2011.

(30) Foreign Application Priority Data

Mar. 22, 2010 (DE) ..... 10 2010 012 279

(51) Int. Cl.
*F02B 75/32* (2006.01)

(52) U.S. Cl.
USPC ..... 123/197.1; 123/DIG. 8; 60/361; 74/606 R; 192/3.28

(58) Field of Classification Search
USPC ..... 123/197.1, DIG. 8; 60/361; 74/606 R; 192/3.28
See application file for complete search history.

(56) References Cited

U.S. PATENT DOCUMENTS

| | | | | |
|---|---|---|---|---|
| 4,373,481 | A | 2/1983 | Krueger et al. | |
| 4,555,003 | A * | 11/1985 | Phillips | 192/53.51 |
| 5,727,513 | A | 3/1998 | Fischer | |
| 2009/0145396 | A1 | 6/2009 | Almkvist et al. | |

FOREIGN PATENT DOCUMENTS

| | | |
|---|---|---|
| DE | 3017092 | 11/1981 |
| DE | 3145381 | 5/1983 |
| EP | 0793001 | 9/1997 |
| EP | 2067961 | 6/2009 |

* cited by examiner

*Primary Examiner* — Lindsay Low
*Assistant Examiner* — Ruben Picon-Feliciano
(74) *Attorney, Agent, or Firm* — Simpson & Simpson, PLLC

(57) ABSTRACT

The invention relates to an internal combustion engine comprising a plurality of subunits which each comprise a crankshaft part, at least one piston being accommodated on a crank of each crankshaft part by means of a connecting rod, wherein at least one first subunit is permanently operated while the internal combustion engine is operating, and at least one additional subunit can be switched off. To switch off a subunit and to disconnect the crankshaft parts from each other, the crankshaft parts of at least one first subunit and an adjacent second subunit that can be switched off are connected to each other in a rotationally locked manner and can move relative to each other with respect to the rotational axes thereof in such a way that a rotational motion applied to the crankshaft part of the second subunit by the crankshaft part of the first subunit is substantially suspended.

11 Claims, 7 Drawing Sheets

SYNCHRONIZING CLUTCH MECHANISM FOR A SPLIT CRANKSHAFT IN AN INTERNAL COMBUSTION ENGINE

CROSS-REFERENCE TO RELATED APPLICATIONS

This application is filed under 35 U.S.C. 111(a) as a continuation of International Patent Application No. PCT/DE 2011/000194 filed Feb. 28, 2011 and claiming priority of German Patent Application No. 10 2010 012 279.3 filed Mar. 22, 2010, which applications are incorporated herein by reference in their entireties.

FIELD OF THE INVENTION

The invention relates to an internal combustion engine comprising a plurality of subunits which each comprise a crankshaft part, at least one piston being accommodated on a crank of each crankshaft part by means of a connecting rod, wherein at least one first subunit is permanently operated while the internal combustion engine is operating, and at least one additional subunit can be switched off.

BACKGROUND OF THE INVENTION

Internal combustion engines chemically convert the energy stored in fuel by combustion into kinetic energy by moving up and down pistons accommodated on a crankshaft by means of connecting rods in a reciprocating piston internal combustion engine according to a two or four cycle principle while rotating the crankshaft and cylinders. Particularly in motor vehicles, internal combustion engines must have a wide performance range to meet the performance requirements of different modes such as city driving, interurban driving and highway driving. Most internal combustion engines are therefore over-dimensioned for the average performance requirements and are thus operated at lower efficiency, resulting in an elevated demand for fuel. To increase efficiency within the partial load range, it is proposed to shut off individual cylinders of the internal combustion engine, that is, not to fire them by not supplying fuel to the cylinders and opening the valves to control the exchange of gas. In such embodiments, the connecting rods and pistons for the shut-off cylinders need to continue operating under a corresponding expenditure of energy to further improve the efficiency of such internal combustion engines.

To further improve efficiency, a reciprocating piston internal combustion engine disclosed in DE 31 45 381 A1 is divided into two subunits which each containing a part of the working cylinders of the internal combustion engine, the connecting rods and pistons of which are connected to a crankshaft part. The crankshaft parts of the two subunits can be coupled to each other by means of a clutch, so that both subunits can be combined under a full load when the clutch is engaged, and a subunit can be decoupled in the partial load range by disengaging the clutch. The decoupling occurs by axially shilling the decouplable subunit, wherein its crankshaft part and the connecting rods on the crankshaft cranks must be accommodated in axial floating bearings. The crankshaft must be precisely positioned in relation to the housing of the internal combustion engine, and the connecting rods on the crankshaft must be precisely positioned in relation to the pistons operating in the housing. The two subunits of the internal combustion engine are turned on and off by means of a device for axially shifting that must be operated with additional energy under a full load, which in turn reduces the efficiency of the internal combustion engine.

BRIEF SUMMARY OF THE INVENTION

According to the invention, the connection locked against rotation between the two neighboring subunits is maintained while the two subunits are being disconnected by a parallel shift of their crankshaft parts. By means of the parallel shift, the strokes of the pistons that are set by the cranks of the crankshaft parts of the two subunits are relativized in relation to each other such that the strokes of the pistons of the subunit to be shut off decrease in relation to each other as the distance between the rotary axes of the crankshaft parts increases and, at a given distance between one crankshaft part and the other that basically corresponds to the distance between the rotary axes the cranks of the crankshaft parts from their rotary axes, become zero. The axially fixed bearing of the two crankshaft parts in their seats fixed relative to the housing can thereby be retained, and the connecting rods remain mounted axially fixed on the cranks. The subunits can be part of an internal combustion engine when the cylinders are in-line or in a V-shaped arrangement. When the cylinders are in a V-shaped arrangement, two connecting rods can be provided on a crank of the crankshaft parts. The internal combustion engine can be designed to be for diesel or gas and have camshafts or individually controlled valves for the exchange of gas.

According to the inventive idea, a plurality, preferably two, completely formed subunits with separate housings, cylinder and valve arrangements can be shifted parallel in relation to each other, wherein the rotary axes of their crankshaft parts are simultaneously shifted parallel in relation to each other and, when the crankshaft parts are coaxially arranged, both subunits are connected to a single internal combustion engine, wherein all cylinders work together with constant piston strokes. According to a preferred exemplary embodiment, a single housing is provided for the internal combustion engine in which one or more subunits are fixedly accommodated with pistons, connecting rods and crankshaft parts, and one or more subunits are accommodated on a slide arranged to be slightly shiftable in relation to the housing. Just the corresponding crankshaft part can be mounted axially fixed on the slide with the connecting rods and pistons of a subunit, wherein it is guided mobile in parallel in an axially fixed manner substantially perpendicular to the rotary axis of the crankshaft part of the permanently driven subunit.

To form the rotary lock between the crankshaft parts of a first permanently operated subunit and a second decouplable subunit, an extensible eccentric arm can be provided depending on the shift of the crankshaft parts. The eccentric arm is fastened in a fixed manner to one of the crankshaft parts and fastened in a rotatable manner to the other, for example by means of a bearing pin. Such a bearing pin can be accommodated in the associated crankshaft part and borne by a friction bearing or roller bearing. The difference in length to be compensated during the shift and parallel displacement of the two crankshaft parts is compensated for by means of a linear guide in the eccentric arm according to the idea underlying the invention. This can be a linear guide borne by a roller or friction bearing that can transmit force in the peripheral direction and can be designed to be at least non-detachable in an axial direction. If a friction bearing is used, a so-called dovetail guide has proven to be advantageous.

The eccentric arm on one of the crankshaft part is on its rotary axis and on the other crankshaft part is basically offset from the rotary axis of the crankshaft part by a distance corresponding to a distance between the rotary axis of the crankshaft part and the rotary axis of the crankshaft crank, and is fixedly arranged on one of the crankshaft parts and rotatably arranged on the other crankshaft part. According to the idea underlying the invention, one advantageous embodiment of an internal combustion engine has a permanently operated subunit that possesses a crankshaft part fixedly mounted relative to a housing, wherein the crankshaft part of the subunit that can be shut off can be shifted in parallel to the rotary axis of the crankshaft part of the permanently operated subunit, the non-shiftable crankshaft part accommodates the eccentric arm, and the shiftable crankshaft part is connected locked against rotation to the non-shiftable crankshaft part by means of a bearing pin that is provided on the eccentric arm, is radially offset relative to the rotary axis of the shiftable crankshaft part and is radially shiftable relative to the rotary axis of the non-shiftable crankshaft part depending on a shift of the shiftable crankshaft part.

To exploit the Coriolis force when coupling the decoupled subunit, the eccentric arm has a center of gravity when the subunit is shut off outside of the rotary axis of its crankshaft part. When the crankshaft part shifts back into the coaxial position with the crankshaft part of the permanently driven subunit, the mass part of the eccentric arm lying radially to the outside undergoes rotary acceleration in the form of a pirouette due to the arising rotary movement of the crankshaft parts of the coupled crankshaft part, so that it benefits from the torque of the parallel shift arising from the reduced radius of the mass part, and the shifting force, as well as the actuator force, is reduced.

In addition, axial pretension of the crankshaft parts of a permanently driven and engaged subunit can be provided, according to the idea underlying the invention, so that they are clamped axially against each other free of play. In a coaxial arrangement of the crankshaft parts, the initial tension can, for example, be provided by exerting axial pressure on the eccentric arm arising from pressure transmitted to the crankshaft part and shifting a hydraulic piston. In a similar manner, the subunits can be clamped together axially free of play when the subunit is coupled. For example, the slide accommodating at least one crankshaft part of the decouplable subunit can be axially clamped free of play against a housing accommodating a permanently operated subunit.

Operation according to the following method brings about an advantageously designed exemplary embodiment: When the crankshaft parts are arranged coaxially in relation to each other, all of the connecting rods are arranged in a line about a rotary axis of the crankshaft of the internal combustion engine. The uniform cranks of the crankshaft parts provide a dual piston stroke. The crankshaft parts are connected to each other by means of the eccentric arm, the dovetail guide is compressed into a minimum compensation path, and the bearing bolt transmits the gas force conveyed via the connecting rods by the pistons into the crankshaft part of the engaged subunit to the crankshaft part of the permanently operating subunit. To decouple the subunit which can be shut off, the crankshaft part of the subunit that can be shut off, including the bearing, is preferably shifted over one half of a rotation of the crankshaft by means of the actuator into a position at a distance from the rotary axis of the crankshaft part of the permanently operated subunit that substantially corresponds to a distance of the rotary axis of a crank to the rotary axis of the crankshaft part. The eccentric arm is correspondingly extended on its linear guides such as a dovetail connection. Given the kinematics of the eccentric lever, the crankshaft part does not undergo any rotation at the set position of the shutoff subunit, despite the co-rotation of the eccentric lever from the crankshaft part of the permanently operated subunit. Rather, only the bearing bolt arranged on the rotary axis of the permanently operated crankshaft part rotates in the bolt seat of the shut-off crankshaft part and thereby does not transmit any torque to the shut-off crankshaft part. To re-couple the shut-off subunit, the actuator, supported by the pirouette effect of the Coriolis force acting on the mass part of the eccentric arm, shifts the crankshaft part with its rotary axis toward the rotary axis of the permanently operated crankshaft part, the bearing pin leaves the rotary axis of the permanently operating crankshaft part, whereby a pivoted lever is formed between the hole pin and permanently driven crankshaft part, so that the crankshaft part of the permanently driven subunit is again driven. Pre-tensioning actions can be initiated to compensate for axial play between the rotary lock connection between the crankshaft parts and/or the components assuming the bearing of the crankshaft parts.

The object of the invention is to improve the efficiency of internal combustion engines, in particular with a plurality of subunits that can be disconnected.

The object is achieved by an internal combustion engine comprising a plurality of subunits which each comprise a crankshaft part, at least one piston being accommodated on a crank of each crankshaft part by means of a connecting rod, wherein at least one first subunit is permanently operated while the internal combustion engine is operating, and at least one additional subunit can be switched off, wherein to switch off a subunit and to disconnect the crankshaft parts from each other, the crankshaft parts of at least one first subunit and an adjacent second subunit that can be switched off are connected to each other in a rotationally locked manner and can move relative to each other with respect to the rotational axes thereof in such a way that a rotational motion applied to the crankshaft part of the second subunit by the crankshaft part of the first subunit is substantially suspended.

BRIEF DESCRIPTION OF THE DRAWINGS

The invention will be further explained with reference to the exemplary embodiment portrayed in FIGS. 1 to 7. The drawings show the following.

DETAILED DESCRIPTION OF THE INVENTION

Figure 1:
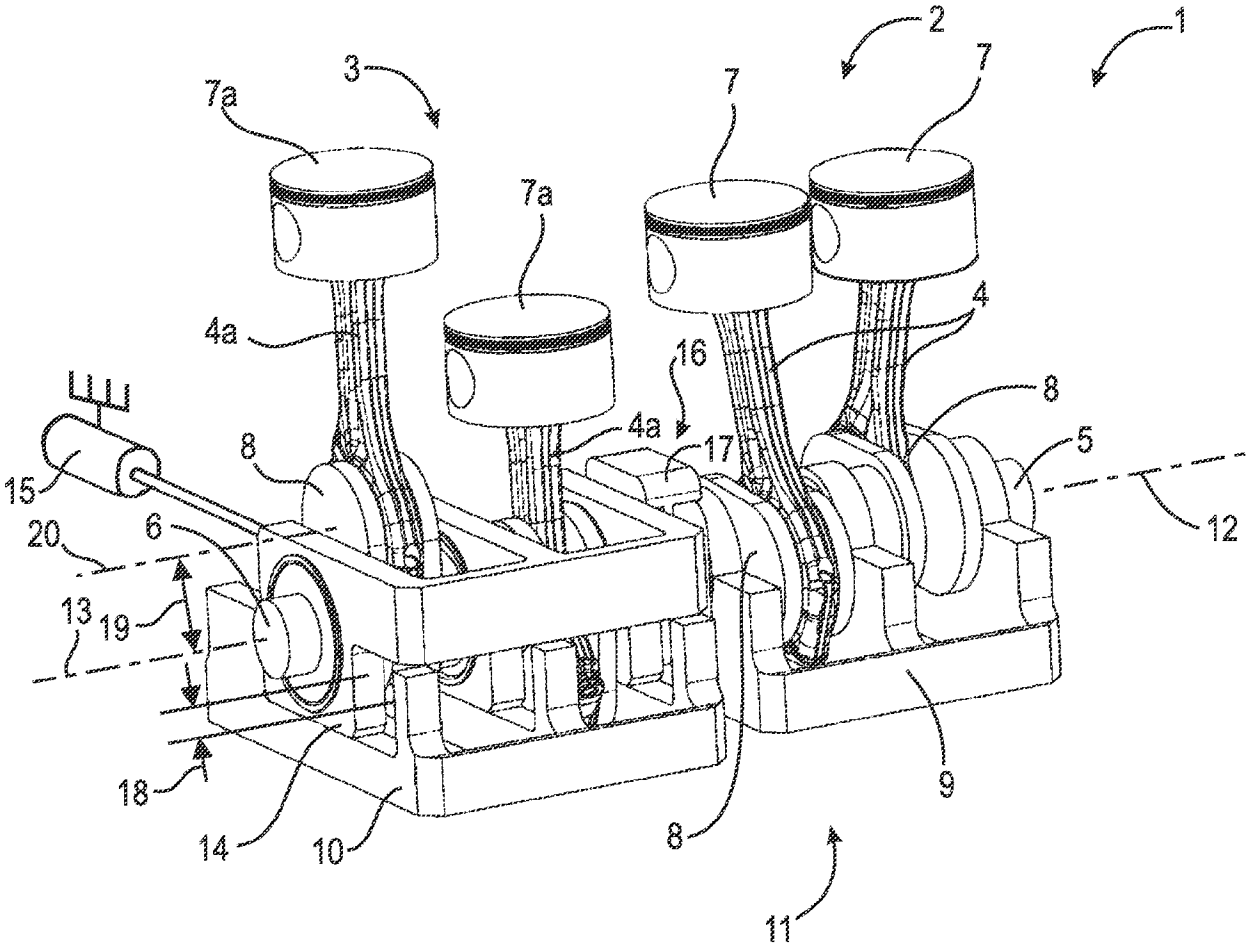
FIG. 1 is an angled view of an internal combustion engine with two couplable subunits, omitting the cylinder housing, when the two subunits are in a coupled state.

FIG. 1 shows the internal combustion engine 1 in a schematic angled view with the subunits 2, 3, each with two pistons 7, 7*a* arranged in a line and arranged by means of the connecting rods 4, 4*a* on the crankshaft parts 5, 6. The pistons 7, 7*a* are guided in a cylinder housing (not shown) along a piston stroke determined by the cranks 8 of the crankshaft parts 5, 6, and form with them and a cylinder head (not shown)

with valves for controlling the gas exchange and possibly ignition devices, the swept volumes of the internal combustion engine 1.

The two subunits 2, 3 can be connected to each other by means of the two housing parts 9, 10 that can also be combined into a common housing 11. The subunit 2 is provided as a permanently operated subunit of the internal combustion engine that always operates while the internal combustion engine 1 is operating, whereas the subunit 3 is designed to be shut off. The crankshaft part 5 of the subunit 2 is fixedly mounted in the housing part 9 and is thereby fixedly accommodated in the common housing 11 and can rotate about its rotary axis 12. The crankshaft part 6 of the subunit 3 with the rotary axis 12 is fixedly mounted axially on the slide 14 that is shiftable relative to the housing part 10 and hence relative to the housing 11 parallel to the rotary axis 12. The slide is shifted by means of the actuator 15 (which is only schematically indicated) that shifts the slide 14 hydraulically, electrically or in another manner, and is controlled by a control unit such as the engine control unit. The slide 14 is shiftable by the distance 18 that basically corresponds to the distance 19 between the rotary axis 13 and the rotary axis 20 of the crank 8 by which the connecting rods 4 can rotate about the crank 8.

The rotary lock connection 16 acts between the crankshaft parts 5, 6 that is formed by the eccentric arm 17 with a compensation in length which causes a rotary coupling of the two crankshaft parts in the state portrayed here of the coaxial arrangement of the rotary axes 12, 13 of the crankshaft parts 5, 6 such that the torque introduced by the combustion of fuel into the swept volumes and subsequent acceleration of the pistons 7*a* in the crankshaft part 5 is completely transmitted to the crankshaft part 5.

Figure 2:
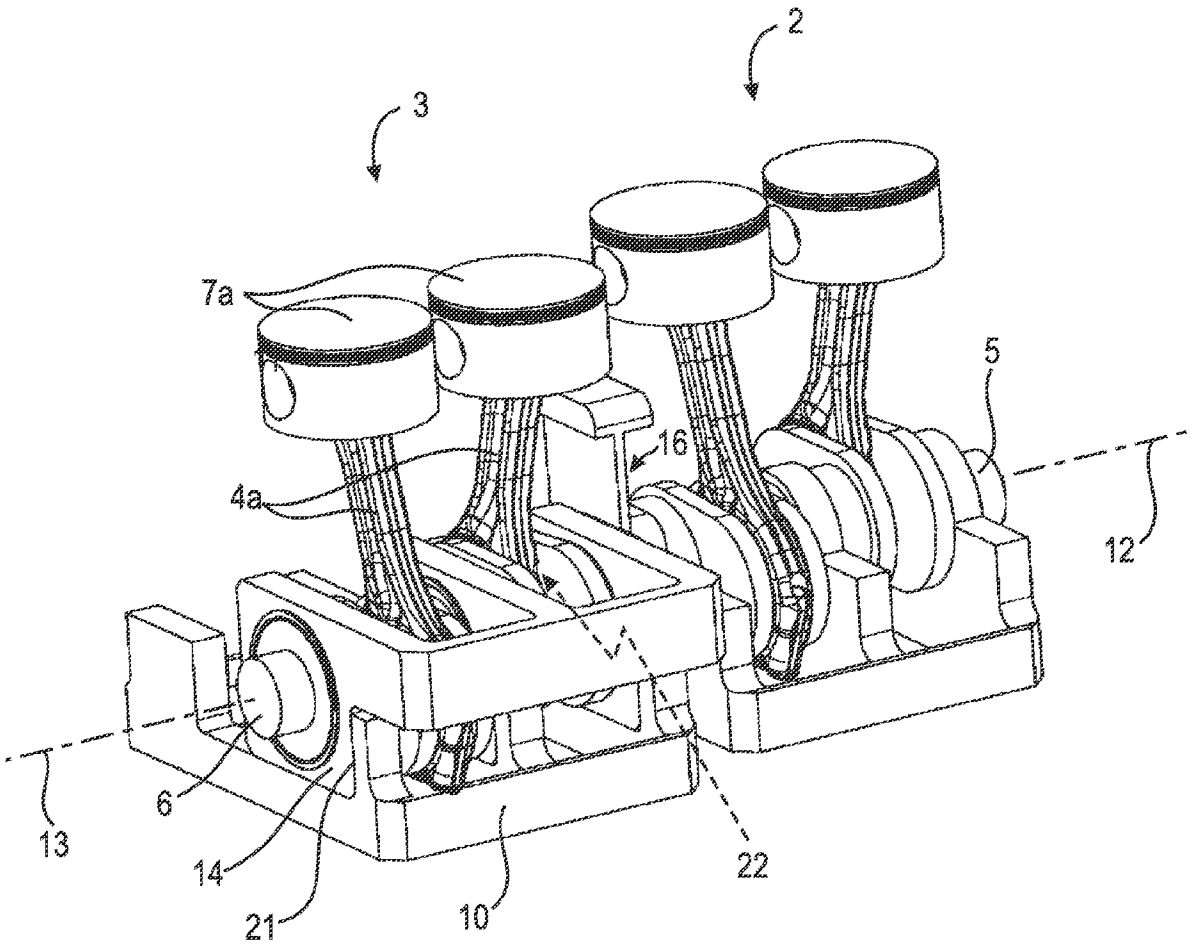
FIG. 2 is an angled view of the internal combustion engine from FIG. 1 when the decouplable subunit is in a decoupled state.

FIG. 2 shows the internal combustion engine 1 from FIG. 1 when subunit 3 is decoupled from subunit 2. The slide 14 has moved up to the stop 21 of the housing part so that the two rotary axes 12, 13 of the crankshaft parts 5, 6 are correspondingly shifted by the distance 19 (FIG. 1), and the rotary axis 12 is arranged basically coaxial to the rotary axis 22 that is basically at the distance 19 (FIG. 1) to the rotary axis 13. The rotary lock connection 16 is correspondingly shifted so that it does not transmit any torque. Consequently, after the cylinders with the pistons 7*a* have been shut off and not filled, the connecting rods 4*a* and pistons 7*a* of the subunit 3 do not move, and there is no pumping movement from entrainment by the crankshaft part 5.

Figure 3:
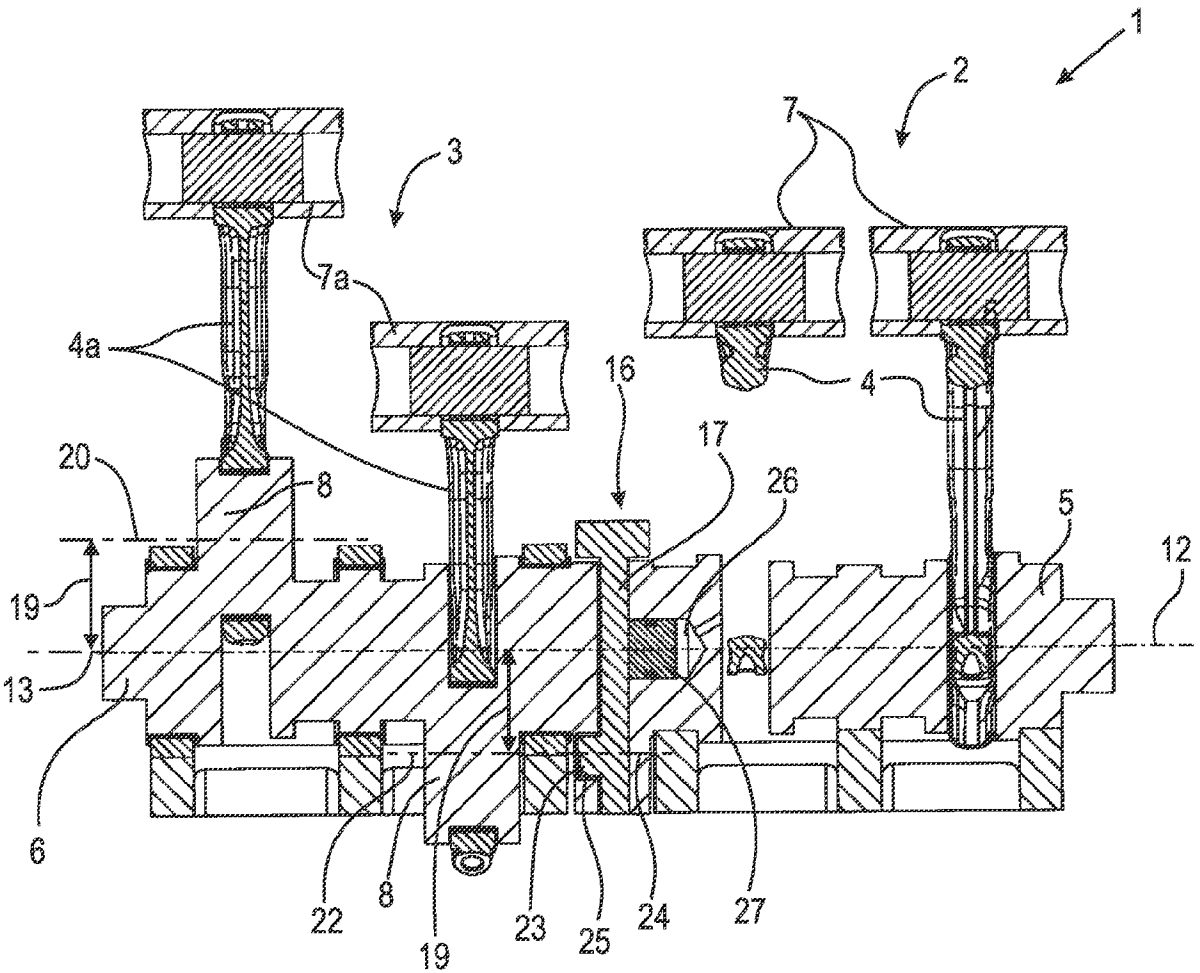
FIG. 3 is a section of the internal combustion engine from FIGS. 1 and 2 when the subunits are in a coupled state.

FIG. 3 shows a section of an internal combustion engine 1 with subunits 2, 3 when the subunit 3 is coupled and the rotary axes 12, 13 are arranged coaxially. The crankshaft parts 5, 6 are each mounted axially fixed in the housing part 9 (FIG. 1) or in the slide 14 (FIG. 1). The connecting rods 4, 4*a* with the pistons 7, 7*a* are mounted axially fixed in the cranks 8 of the crankshaft parts 5, 6 with the same distance 19 between the rotary axes 12 or 13 and the rotary axes 20, 22 of the cranks 8.

The rotary lock connection 16 is formed by the eccentric arm 17 with a variable length and the crank pins 23. The crank pin 23 is rotatably accommodated in the bearing bush 25 arranged at a distance 19 to the rotary axis 13 and, when the subunit 3 is engaged, it is positioned with its rotary axis 24 coaxial to the rotary axis 22 of the connecting rod 4*a* in the bearing bush 25 of the crankshaft part 6. The eccentric arm 17 is non-rotatably connected coaxially to the crankshaft part 5 of the subunit 2 so that torque can be transmitted by the rotary lock connection 16 due to the arrangement radially offset by distance 19 between the rotary axis 12 of the crankshaft part 5 and the crank pin 23 of the eccentric arm 17 mounted in the crankshaft part 6, and the two crankshaft parts can be connected coaxially with each other locked against rotation.

To prevent axial play in the eccentric arm 17 relative to the bearing bush 25, the bearing bush can be axially clamped. In the portrayed exemplary embodiment, the piston 27 that is shiftable in the chamber 26 is provided, wherein the chamber 26 is supplied a pressure medium, for example, by means of a rotary feed-through, and the piston 27 is clamped against the eccentric arm 17. In this manner, the axial compensation of the eccentric arm can also be blocked.

Figure 4:
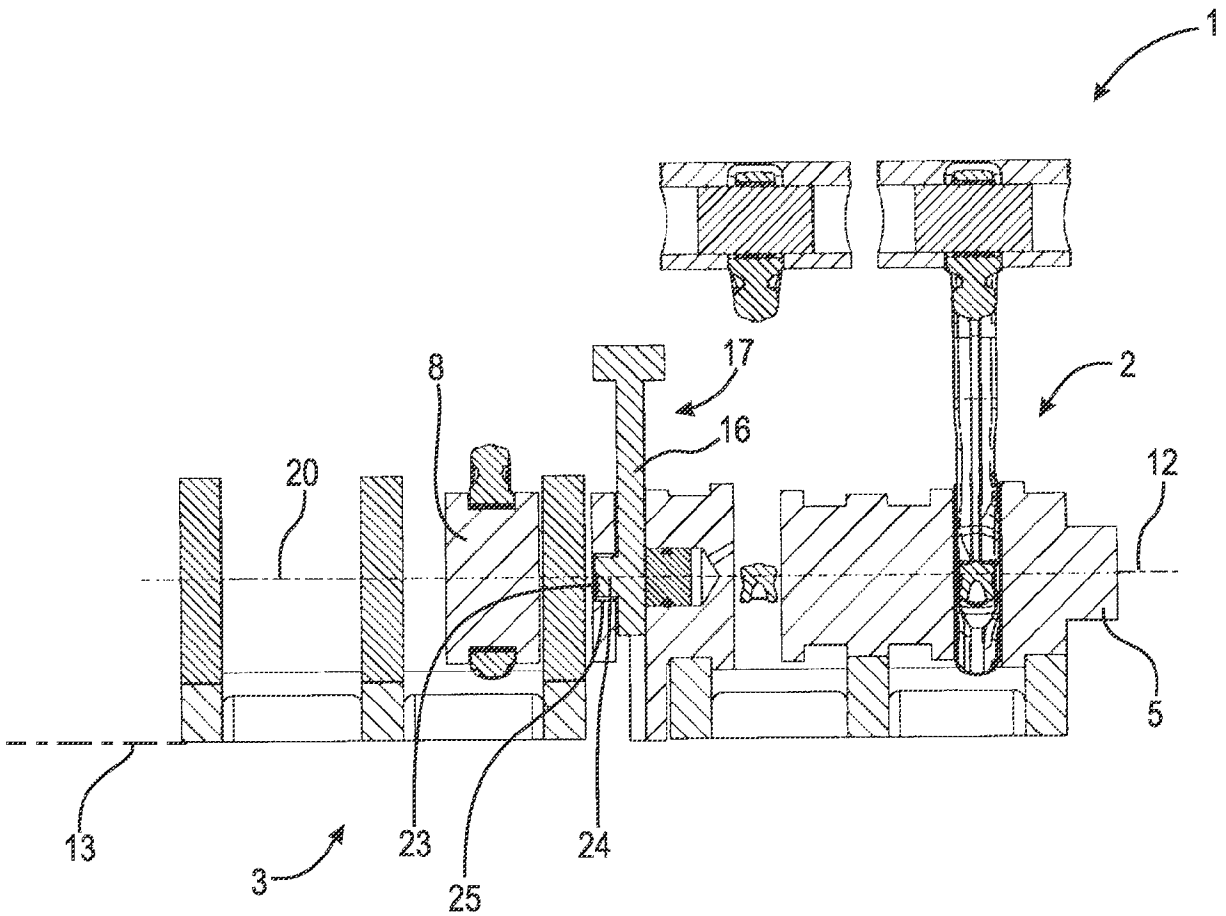
FIG. 4 is a partial section of the internal combustion engine from FIGS. 1 to 3 when the subunit is decoupled.

FIG. 4 shows a partial section of the top part of the internal combustion engine 1 arranged around the rotary axis 13 of the subunit 3 when subunit 3 is decoupled from subunit 2. The rotary axis 13 of subunit 3 is shifted relative to rotary axis 12 of the crankshaft part 5 so that the rotary axis 24 of the crank pin 23 coinciding with the rotary axis of the crank 8 coincides with a rotary axis of the bearing bush 25. Due to the coaxial arrangement of the crankshaft part 5 and crank pin 23, no torque can be transmitted by means of the rotary lock connection 16; the crank pin 23 only rotates in the bearing bush 25 when the crankshaft part 5 rotates, and the pistons of subunit 3 (not shown) are therefore shut off.

Figure 5:
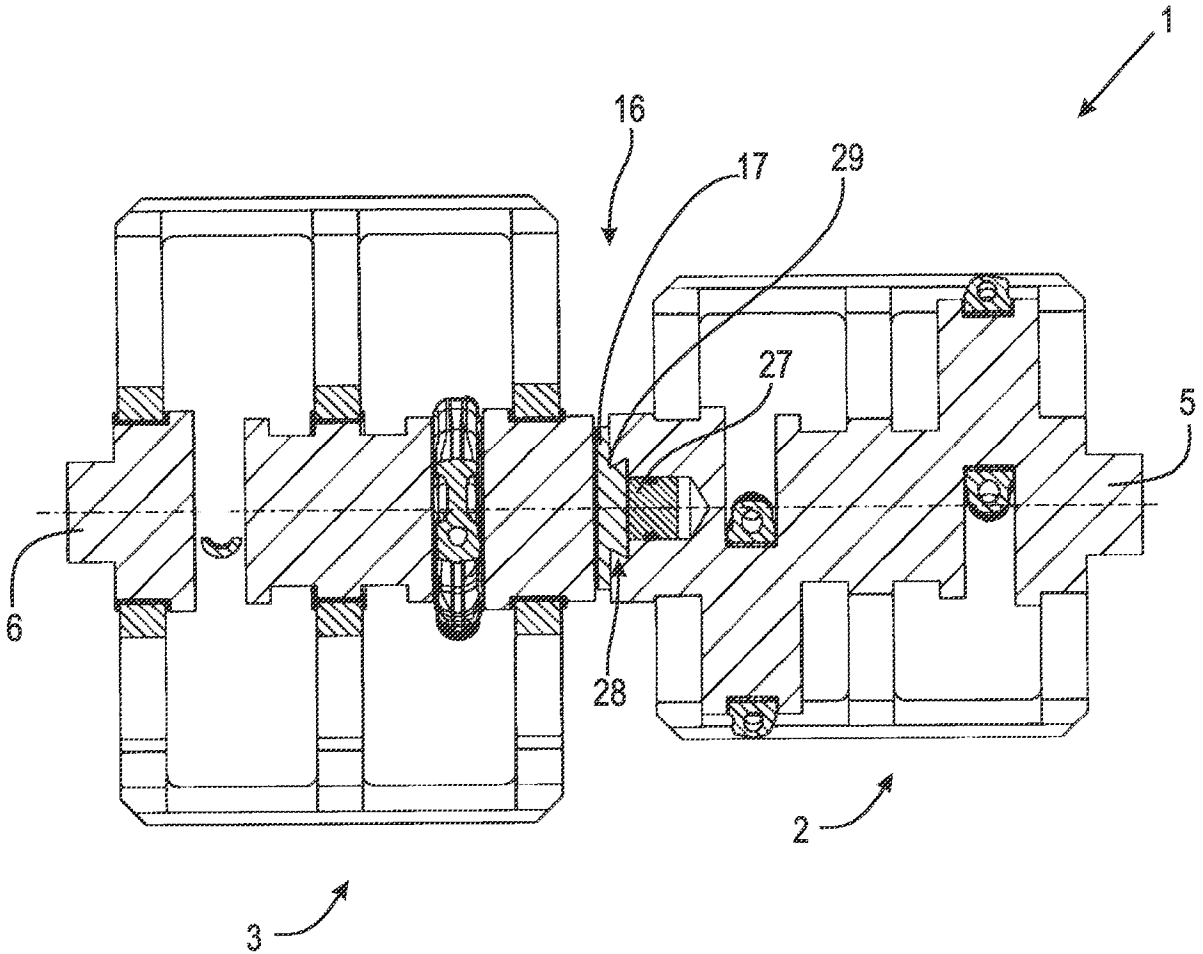
FIG. 5 is a section of the internal combustion engine from FIGS. 1 to 4 perpendicular to the operating direction of the pistons.

The required change in length of the eccentric arm 17 can be seen in FIG. 5 which shows a section of the internal combustion engine 1 with subunits 2, 3 from below. The rotary lock connection 16 with the eccentric arm 17 possesses a length compensation that is designed as a linear guide 28 in the form of a dovetail connection 29. Complementary profiles with undercuts are provided in the crankshaft part 5 and eccentric arm 17 that slide on each other and allow a non-rotating connection with radial shiftability. While retaining a rotary lock, a parallel shift of the two crankshaft parts 5, 6 is thereby possible, wherein the rotary lock connection 16 transmits decreasing torque dropping to the value zero depending on the distance of the shift proceeding from the coaxial arrangement of the crankshaft parts 5, 6 to their maximum distance.

Figure 6:
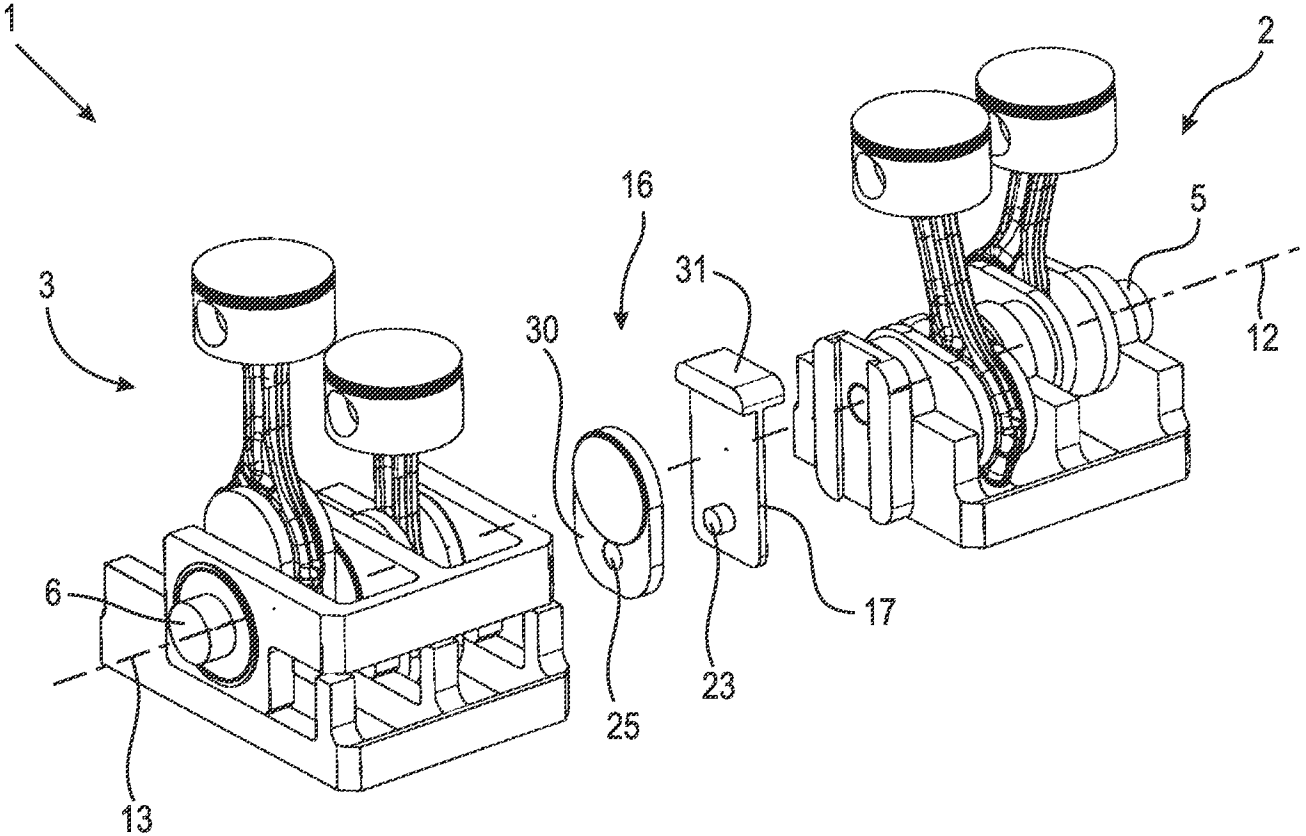
FIG. 6 is an angled view of subunits separate from each other when the subunits are in a coupled state; and, FIG. 7 is an angled view of the subunits separate from each other when the decouplable subunit is in a decoupled state.

FIG. 6 shows the internal combustion engine 1 with subunits 2, 3 that are separate for the sake of clarity, and the positioning of the rotary lock connection 16 when the two subunits 2, 3, are in a coupled state. The coaxial arrangement of the rotary axes 12, 13 of the crankshaft part 5, 6 forces the eccentric arm 17 into a position where the crank pin 23 is at radial distance relative to the rotary axes 12, 13 so that the tab part 30 non-rotatably and coaxially connected to the crankshaft part 6 correspondingly aligns the bearing bush 25 at a radial distance from the rotary axis 13 for accommodating the crank pin 23. The bearing bush and crank pin 23 form a pivoted lever relative to the rotary axes 12, 13 and thereby transmit torque between the two crankshaft parts.

As can also be seen in FIG. 6, the eccentric arm 17 has a mass part 31 radially opposite to the crank pin 23 to achieve an equivalent moment of inertia when the subunits are in a coupled state.

Figure 7:
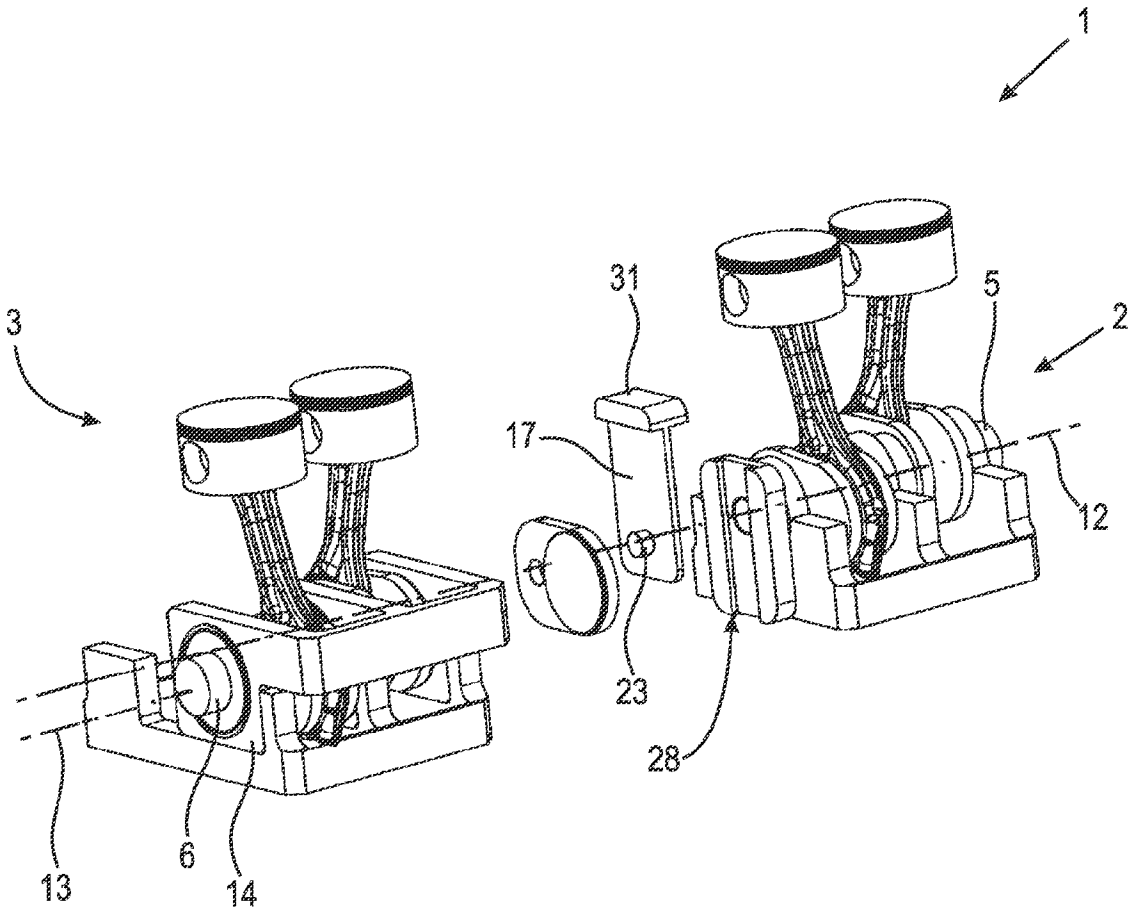

In contrast to the depiction of the internal combustion engine 1 in FIG. 6, FIG. 7 shows the internal combustion engine 1 with decoupled subunits 2, 3. Under the influence of the parallel shift of the rotary axes 12, 13 of the crankshaft parts 5, 6, the eccentric arm 17 is shifted radially to the outside, and the crank pin 23 is shifted on the rotary axis 12 of the crank shaft part 5.

When subunit 3 is shifted back, the eccentric arm 17 travels radially inward along the linear guide 28. The mass part 31 executes a pirouette movement radially inward when the crankshaft part 5 rotates, so that the active Coriolis force causes the slide to accelerate which supports the movement of the slide in the coaxial alignment of the rotary axes 12, 13 of the crankshaft parts 5, 6. Consequently, the actuator 15 (FIG. 1) can be designed with weaker performance and can be optimized in regard to the speed of the shift of the slide 14 to be executed so that the coupling and decoupling of the subunit 3 from the subunit 2 can occur over one half of a crankshaft rotation of the crankshaft part 5. The radial shift and parallel displacement of the slide 14 is supported by the dynamic relationships of the speeds of the crankshaft parts 5, 6.

REFERENCE NUMERALS

1 Internal combustion engine
2 Subunit
3 Subunit
4 Connecting rod
4*a* Connecting rod
5 Crankshaft part
6 Crankshaft part
7 Piston
7*a* Piston
8 Crank
9 Housing part
10 Housing part
11 Housing
12 Rotary axis
13 Rotary axis
14 Slide
15 Actuator
16 Rotary lock connection
17 Eccentric arm
18 Distance
19 Distance
20 Rotary axis
21 Stop
22 Rotary axis
23 Crank pin
24 Rotary axis
25 Bearing bush
26 Chamber
27 Piston
28 Linear guide
29 Dovetail connection
30 Tab part
31 Mass part

What is claimed is:

1. An internal combustion engine, comprising:

a first subunit including a first crankshaft part and a first rotary axis;

a second subunit including a second crankshaft part and a second rotary axis;

at least one respective piston being accommodated on a respective crank of each said first and second crankshaft parts by means of a first and second connecting rod, respectively; and, an eccentric arm non-rotatably connected to said first crankshaft part, wherein:

said first subunit is permanently operated while said internal combustion engine is operating;

said second subunit can be switched off;

in a first position, said eccentric arm rotationally connects said first and second crankshaft parts; and, said eccentric arm is arranged to be displaced in a direction orthogonal to said first and second rotary axes from said first position to rotationally disconnect said first and second crankshaft parts.

2. The internal combustion engine recited in claim 1, wherein said eccentric arm extensible depending on the shift of said first and second crankshaft parts acts between said first and second crankshaft parts of said first and second subunits.

3. The internal combustion engine recited in claim 2, wherein said eccentric arm is designed to be extensible by means of a linear guide.

4. The internal combustion engine recited in claim 2, wherein said eccentric arm on said first rotary axis of said first crankshaft part and on said second crankshaft part is basically offset from said second rotary axis of said second crankshaft part by a distance between said second rotary axis of said second crankshaft part and a rotary axis of said respective crank, and said eccentric arm is fixedly arranged on said first crankshaft part and rotatably arranged on said second crankshaft part.

5. The internal combustion engine recited in claim 2, wherein said permanently operated subunit having said first crankshaft part fixedly mounted relative to a housing, and said second crankshaft part of said second subunit that can be shut off can be shifted in parallel to said first rotary axis of said first crankshaft part of said permanently operated subunit, wherein said non-shiftable first crankshaft part accommodates said eccentric arm, and said shiftable second crankshaft part is connected in a manner locked against rotation to said non-shiftable first crankshaft part by means of a crank pin that is provided on said eccentric arm, is radially offset relative to said second rotary axis of said second shiftable crankshaft part and is radially shiftable relative to said first rotary axis of said first non-shiftable crankshaft part depending on a shift of said first shiftable crankshaft part.

6. The internal combustion engine recited in claim 1, wherein said second subunit is arranged to be shiftable in parallel by means of an actuator relative to said first subunit in reference to their respective rotary axes.

7. The internal combustion engine recited in claim 1, wherein said second shiftable subunit is accommodated on a slide that is arranged to be slightly shiftable relative to said housing with said non-shiftable subunit.

8. The internal combustion engine recited in claim 1, wherein said eccentric arm has a center of gravity that lies outside of said first rotary axis of its respective crankshaft part when said second subunit is turned off.

9. The internal combustion engine recited in claim 1, wherein said first and second crankshaft parts of a permanently driven and an engaged subunit are clamped against each other free of play.

10. The internal combustion engine recited in claim 7, wherein said housing and said slide are clamped against each other free of play when said second subunit is engaged.

11. An internal combustion engine, comprising:

a first subunit with a first crankshaft part and a first rotary axis; and, a second subunit with a second crankshaft and a second rotary axis, wherein:

in a first position of the second subunit, the first and second rotary axes are coaxial and the first and second subunits are rotationally coupled; and, the second subunit is displaceable in an orthogonal direction, with respect to the first rotary axis, such that the first subunit is decoupled from the second subunit.

* * * * *